US006601611B1

(12) United States Patent
Chapman

(10) Patent No.: US 6,601,611 B1
(45) Date of Patent: Aug. 5, 2003

(54) HAND-ACTUATED CONTROL DEVICE, IN PARTICULAR FOR THE HYDRAULIC ACTUATION OF HYDRAULIC VALVES

(75) Inventor: John Chapman, Finham (GB)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/806,284

(22) PCT Filed: Sep. 11, 1999

(86) PCT No.: PCT/EP99/06737

§ 371 (c)(1),
(2), (4) Date: Mar. 28, 2001

(87) PCT Pub. No.: WO00/19108

PCT Pub. Date: Apr. 6, 2000

(30) Foreign Application Priority Data

Sep. 30, 1998 (DE) ..... 198 44 860

(51) Int. Cl.[7] ..... F15B 13/07
(52) U.S. Cl. ..... 137/635; 137/636.2
(58) Field of Search ..... 137/635, 636.2

(56) References Cited

U.S. PATENT DOCUMENTS

| | | | |
|---|---|---|---|
| 4,404,991 | A | 9/1983 | Cullen |
| 5,184,646 | A | 2/1993 | Hori et al. |

FOREIGN PATENT DOCUMENTS

| | | |
|---|---|---|
| DE | 2049869 | 4/1972 |
| DE | 2402057 | 8/1975 |
| DE | 2751946 | 7/1978 |
| DE | 4016977 | 11/1991 |
| DE | 4410201 | 9/1995 |
| DE | 29507179 | 11/1995 |
| DE | 29604210 | 8/1996 |
| DE | 19630798 | 1/1998 |
| EP | 0516870 | 12/1992 |
| FR | 1565205 | 4/1969 |
| GB | 1496955 | 1/1978 |
| GB | 2046022 | 11/1980 |
| GB | 2115526 | 7/1996 |
| WO | 9630652 | 10/1996 |

OTHER PUBLICATIONS

Patent Abstracts of Japan vol. 016, No 165 (M–1238) Apr. 21, 1992 & JP 04 012991 A (Omote Tekkosho:KK) Jan. 17, 1992.

*Primary Examiner*—Gerald A. Michalsky
(74) *Attorney, Agent, or Firm*—Martin A. Farber

(57) ABSTRACT

A hand-actuated control device with an actuating element which extends largely parallel to the axial plane and is fastened to the control lever, the two control signal generators can be actuated individually or jointly in order to generate a control signal. Between two first control signal generators is arranged a further control signal generator. A control lever can be turned together with an actuating element about the lever axis from a first turning position, in which the first control signal generators can be actuated by the actuating element, into a second turning position and vice versa. The actuating element is provided with a recess in such a way that the further control signal generator can be actuated only in the second turning position.

8 Claims, 2 Drawing Sheets

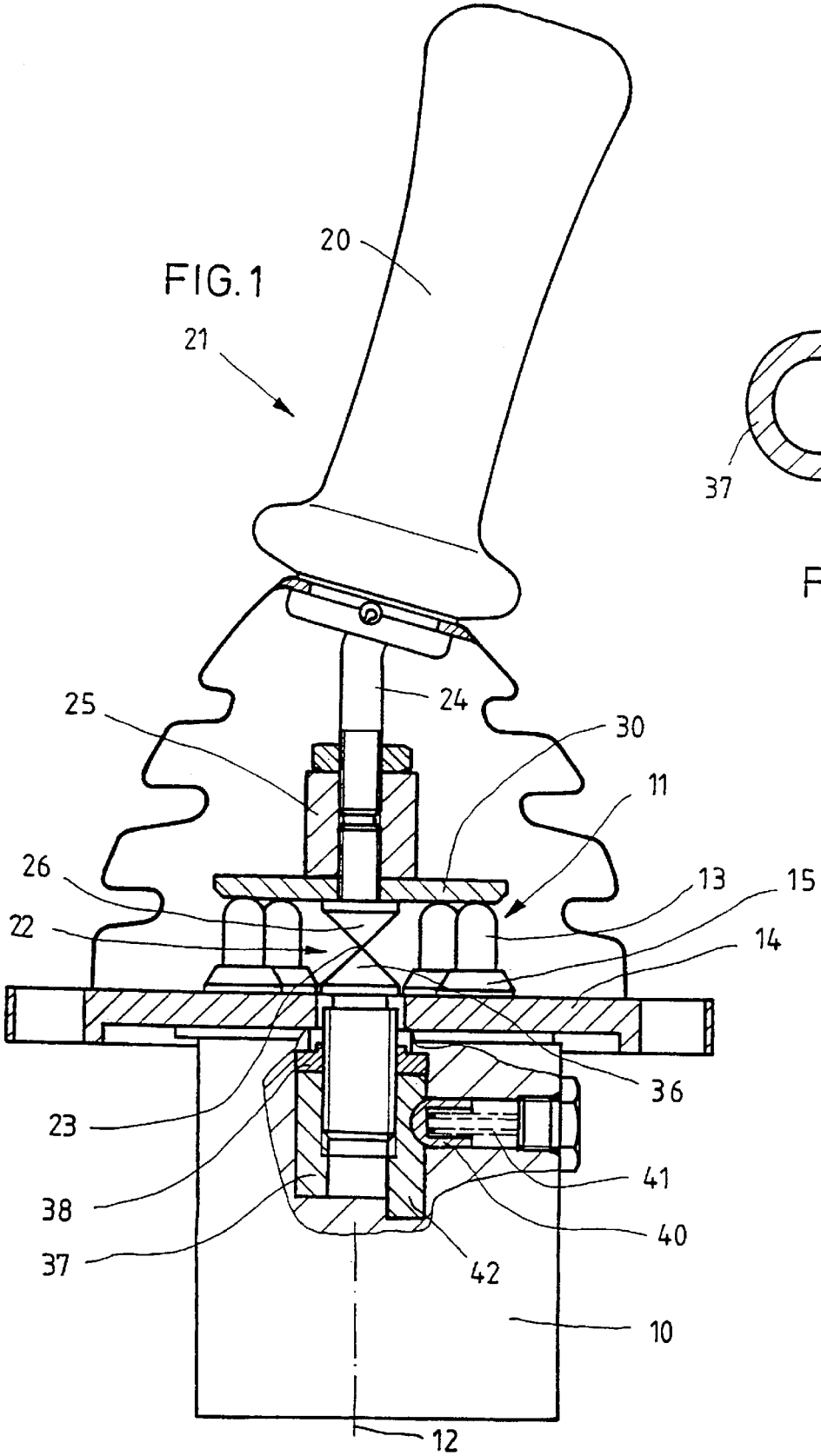
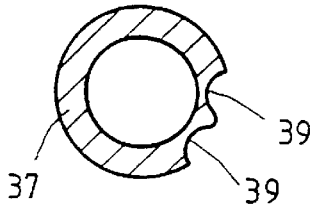
FIG. 2

HAND-ACTUATED CONTROL DEVICE, IN PARTICULAR FOR THE HYDRAULIC ACTUATION OF HYDRAULIC VALVES

FIELD AND BACKGROUND OF THE INVENTION

The invention is based on a hand-actuated control device which is used in particular for the hydraulic actuation of hydraulic valves.

Such a hand-actuated control device is known for example from DE 27 51 946 C2. The control device has a control lever which is mounted cardanically on a device housing by two shafts or shaft stubs, the axes of which form an axial plane and intersect at a swivel point, and is consequently able to be swiveled from a neutral position to all sides about the swivel point. In the case of the known device there are, as control signal generators, four directly controlled pressure-reducing valves, which are arranged at angular intervals of 90 degrees about a lever axis which is perpendicular to the axial plane and passes through the swivel point. Each pressure-reducing valve has an associated tappet, which is guided in the device housing movably parallel to the lever axis, protrudes from the device housing and can be pressed down against the force of a restoring spring and of a control spring of the respective pressure-reducing valve by a plate-like actuating element securely connected to the control lever. The restoring springs acting on the tappet ensure that the control lever in each case assumes a neutral position when it is not being externally actuated and no engagement in a swiveled state is provided for it.

If in the case of the known control device the control lever is swiveled in a plane which is determined by the axes of two diametrically opposed pressure-reducing valves, one of four pressure-reducing valves, that is to say a control signal generator, is actuated. By swiveling the control lever in another plane, it is possible to actuate two pressure-reducing valves simultaneously, the degree of actuation of one pressure-reducing valve in comparison with the degree of actuation of the other pressure-reducing valve being dependent on the position of the swivel plane.

With the known control device, which is customarily used in mobile machines, normally two directional control valve spindles are actuated. For the actuation of further directional control valves, further control devices are necessary. To avoid the expenditure for such further control devices and so as not to take up additional space, it has already been proposed to feed the hydraulic control signals of two pressure-reducing valves of a hydraulic control device which are assigned to the same directional control valve via electromagnetically actuable switching valves to a first or a second directional control valve, allowance having been made for the fact that only some hydraulic consumers of a mobile machine are used simultaneously, while others are always used at different times.

In the case of such pilot control, known from DE 196 30 798 A1, the control device has in addition to four pressure-reducing valves an electric switch, by the actuation which the electromagnets of the switching valves are excited and the switching valves are switched over. It appears to be disadvantageous here that electrical energy has to be additionally supplied to a hydraulic control device which already has a hydraulic pump connection and a hydraulic tank connection. In addition, the actuation of an electric switch requires letting go of the control lever or, if the electric switch is integrated into the control lever, at least altering the way in which it is being gripped. If there is a malfunction of the electric switch, hazardous situations may arise, because valves other than the ones desired are actuated.

SUMMARY OF THE INVENTION

The invention is based on the object of further developing a hand-actuated control device such that a large number of hydraulic valves can be reliably actuated with it, without excessively increasing expenditure.

This object is achieved in the case of a hand-actuated control device according to the invention by this control device being additionally provided with the features disclosed. Accordingly, between two first control signal generators there is arranged a further control signal generator. The control lever can be turned together with the actuating element about the lever axis from a first turning position into a second turning position and vice versa, the first control signal generators being able to be actuated by the actuating element in the first turning position. A recess in the actuating element lies over the further control signal generator when the control lever is in the first turning position, so that said further control signal generator cannot be actuated in the first turning position. By turning the control lever together with the actuating element into the second turning position, a region of the actuating element is moved over the further control signal generator, so that its actuation is possible.

Advantageous refinements of a hand-actuated control device according to the invention can be taken from the subclaims.

In principle, it is conceivable to form the actuating element and arrange the further control signal generator such that, in the second turning position of the control lever, when the further control signal generator is actuated the two first control signal generators are simultaneously also actuated, if the hydraulic consumers are of a type requiring such actuation. If, however, in the second turning position of the control lever, it is to be possible for a control signal generated by the further control signal generator to be emitted simultaneously with a control signal of only one of the first control signal generators, or to be emitted entirely on its own, this is achieved by a form of construction.

The invention can be used with preference in the case of a hand-actuated control device which has four first control signal generators at respective angular intervals of 90 degrees about the lever axis. The activation of a further directional control valve spindle in two directions is possible by being respectively arranged centrally between two first control signal generators two further control signal generators which are diametrically opposite each other in relation to the lever axis, and by the actuating element being provided with four recesses, which in the second turning position are located in the region of the first control signal generators. Consequently, in the first turning position of the control lever only the first control signal generators can be actuated and in the second turning position of the control lever only the further control signal generators can be actuated. It goes without saying that it is possible to arrange at an offset of 90 degrees with respect to the two further control signal generators a second pair of further control signal generators.

The control lever is formed such that it is not rotationally symmetrical in relation to the lever axis, so that it is evident from its position whether it is assuming the first turning position or the second turning position.

BRIEF DESCRIPTION OF THE DRAWINGS

An exemplary embodiment of a hand-actuated control device according to the invention is represented in the drawings. The invention is now explained in more detail on the basis of the figures of these drawings, in which:

FIG. 1 shows the exemplary embodiment partly in elevation and partly in a section through the lever axis in the region of the control lever mounting, FIG. 2 shows a cross section through a bearing bush of the control lever for the turning about the lever axis and FIG. 3 shows in a highly schematized form a plan view of the device housing together with the actuating element for the individual control signal generators, but without the control lever.

DETAILED DESCRIPTION OF THE PREFERRED EMBODIMENT

Figure 3:
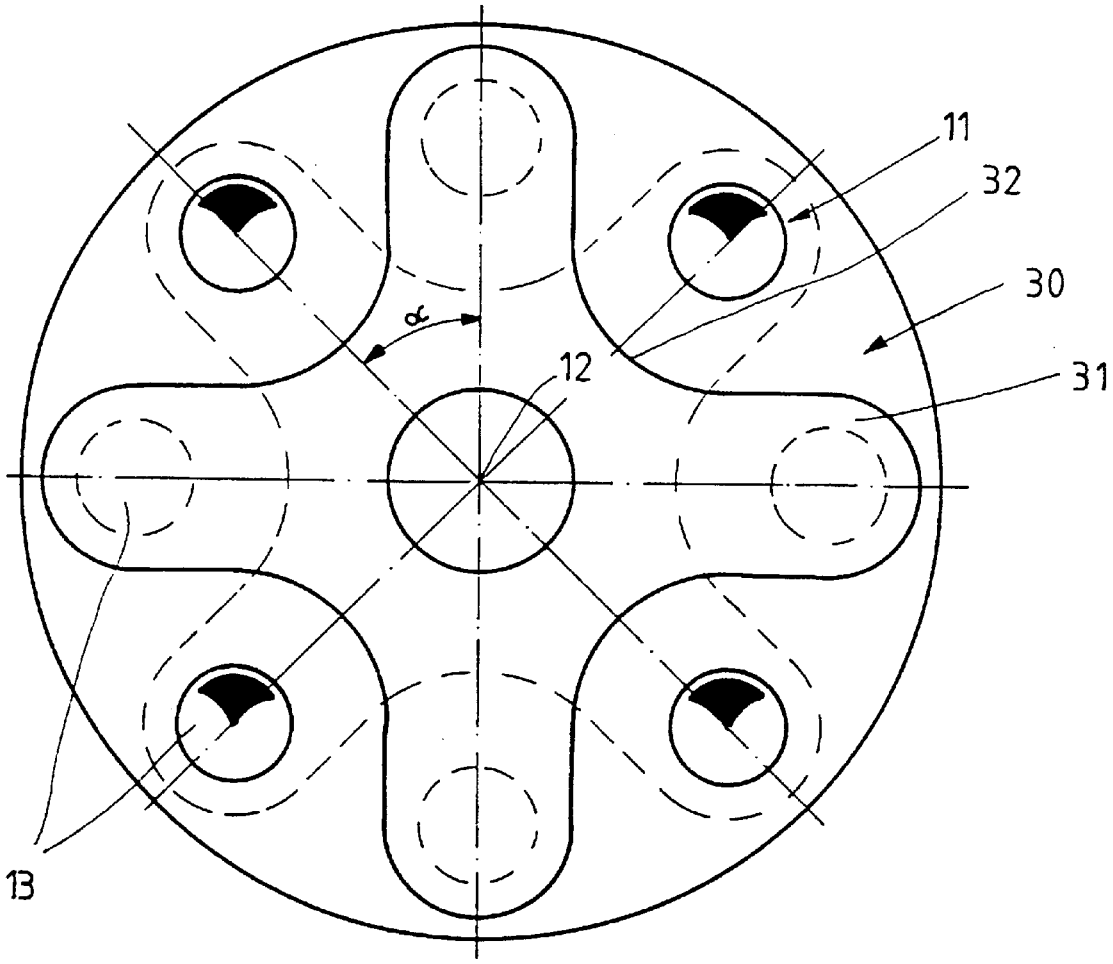

The control device shown is a hydraulic control device which is based on pressure-reducing valves. In a device housing 10 there are altogether eight pressure-reducing valves 11 arranged at mutual angular intervals of 45 degrees around a lever axis 12. The pressure-reducing valves form the control signal generators of the control device. Their internal construction is generally known and is disclosed for example by DE 27 51 946 C2. The figures show only the tappets 13, of which one in each case is assigned to a pressure-reducing valve and which are guided movably in the direction of the lever axis in guide bushes 15 fitted in a fastening, and covering flange 14 of the device housing 10. The tappets 13 protrude with a rounded end beyond the covering flange 14 and the guide bushes 15. The movement of a tappet 13 into the device housing has the effect of stressing a control, spring of a pressure-reducing valve or more generally of actuating a pressure-reducing valve.

This actuation is initiated by the handle 20 of a control lever 21, which is attached to a cardan joint 22 supported by the device housing 10 and only schematically represented. This cardan joint has two shafts, the axes of which are perpendicular to each other and intersect at a swivel point denoted by 23 and form a plane which may be referred to as the axial plane. On account of the cardan joint 22, the control lever 21 can be swiveled to all sides about the swivel point 23. The lever axis is perpendicular to the axial plane and likewise passes through the swivel point 23.

The handle 20 is fastened on a stem 24 of the control lever 21, which stem is bent out of the lever axis 12, so that the control lever 21 as a whole is arranged in such a way that it is not rotationally symmetrical with respect to the lever axis 12. The stem 24 is connected to an upper part 26 of the cardan joint 22 via a bush 25 provided with an internal thread. Clamped in between the upper part 26, screwed into the bush 25, and the bush 25 as an actuating element which acts together with the tappets 13 of the pressure control valves 11 is a plate 30 which extends in a plane running parallel to the axial plane, that is to say is arranged essentially perpendicular to the lever axis 12. The shape of this plate 30 can be seen in particular from FIG. 3. The plate drawn there in solid lines has the form of a cross and is formed with fourfold symmetry in relation to the lever axis 12. The individual arms 31 of the plate 30 are consequently arranged at angular intervals of 90 degrees in relation to the lever axis 12. The plate can be imagined as being formed from a circular plate into which four recesses 32 have been made from the outer edge.

A lower part 36 of the cardan joint 22 is screwed into an engaging bush 37, which is mounted in the device housing 10 rotatably about the axis 12 and is secured on the part 36, for example by a counter nut 38. In the outer surface of the engaging bush 37, in a plane which is perpendicular to the lever axis 12, there are two engaging depressions 39, which are spaced apart from each other by an angular interval of 45 degrees. They act together with a radially arranged engaging bolt 40, which an engaging spring 41 attempts to press into one of the depressions 39. On account of the rotatably mounted engaging bush 37, the control lever 21, and with it the parts of the cardan joint 22, can be turned about the lever axis 12 between a first turning position, in which the engaging bolt 40 enters the one depression 39, and a second turning position, in which the engaging bolt 40 enters the other depression 39. The turning capability is restricted to little more than 45 degrees by an extension 42 which projects axially from the engaging bush 37 and acts together with stops (not represented in any more detail) in the device housing 10.

In the first turning position, the plate 30 is in the position drawn in FIG. 3 in solid lines. It can be seen that the arms 31 extend over the tappets 13 of four first pressure-reducing valves 11 arranged at angular intervals of 90 degrees in relation to one another. If the control lever 21 is then swiveled, one or two of these first pressure-reducing valves are actuated, depending on the swiveling direction. The four further pressure-reducing valves 11, which are likewise at angular intervals of 90 degrees from one another and are offset with respect to the first pressure-reducing valves by 45 degrees, remain uninfluenced by the swiveling of the control lever 21, since they are located in the region of the recesses 32 of the plate 30. To be able to actuate the further pressure-reducing valves 11, the control lever 21 is turned by 45 degrees in relation to the lever axis 12, overcoming the engaging force of the engaging bolt 40 and of the engaging spring 41, whereby the plate 30 moves into the position depicted by broken lines in FIG. 3. The arms 31 are then located over the tappets 13 of the further pressure-reducing valves, while the tappets 13 of, the first four pressure-reducing valves lie in the recesses 32. With a then following swiveling of the control lever 21, one or two of the further pressure-reducing valves 11 are actuated.

As also in the case of the control devices already used today and known for example from DE 27 51 946 C2, the travel of the tappets 13 out of the device housing 10 is limited by a stop, so that the tappets 13 are held on the device housing 10 in spite of the recesses 32 in the plate 30, and the plate 30 can be turned into its neutral position, in which it is located with all parts over the tappets 13, without being hindered by the tappets.

What is claimed is:

1. A hand-actuated control device, with a control lever (21), which is swivelable from a neutral position to all sides about a swivel point (23), about axes lying essentially in an axial plane and intersecting at the swivel point (23), with at least two control signal generators (11), which are arranged spaced apart from one another by a given angle in relation to a lever axis (12) which is perpendicular to the axial plane and passes through the swivel point (23), and with an actuating element (30) which extends largely parallel to the axial plane and with which the two control signal generators (11) are actuatable individually or jointly when the control lever (21) is swiveled out of the neutral position, wherein between the two first control signal generators (11) there is arranged a further control signal generator (11), the control lever (21) is turnable together with the actuating element (30) about the lever axis (12) from a first turning position, in which the first control signal generators (11) are actuatable by the actuating element (30), into a second turning position and vice versa, and that the actuating element (30) is provided with a recess (32) such that the further control signal generator (11) is actuatable only in the second turning position.

2. The hand-actuated control device as claimed in claim 1, wherein in the second turning position, the recess (32) of the actuating element (30) is in a region of a first control signal generator (11).

3. The hand-actuated control device as claimed in claim 2, wherein the actuating element (30) has two recesses (32), one of which is located in a region of the further control signal generator (11) in the first turning position and a respective one of which is located in the region of the first control signal generator (11) in the second turning position.

4. The hand-actuated control device as claimed in claim 3, wherein four first control signal generators (11) are arranged around the lever axis (12) at respective angular intervals of ninety degrees, which are arranged diametrically opposite each other in relation to the lever axis (12) and respectively centrally between two first control signal generators (11) two further control signal generators (11), and the actuating element (30) is provided with four recesses (32), which in the second turning position are located in the region of the first control signal generators (11).

5. The hand-actuated control device as claimed in claim 1, wherein a control lever (21) is formed such that it is rotationally asymmetrical in relation to the lever axis (12).

6. The hand-actuated control device as claimed in claim 1, wherein in at least one of the two turning positions, the control lever (21) is engaged by an engaging device (39, 40, 41).

7. The hand-actuated control device as claimed in claim 1, wherein the at least two control signal generators (11) are arranged from one another by ninety angular degrees in relation to said lever axis (12).

8. The hand-actuated control device as claimed in claim 1, wherein the hand-actuated control device is adapted for a hydraulic actuation of hydraulic valves.

* * * * *